US005639017A

United States Patent [19]

Fogle

[11] Patent Number: 5,639,017

[45] Date of Patent: Jun. 17, 1997

[54] ARTICLE CARRIER WITH INTEGRAL HANDLE

[75] Inventor: James C. Fogle, Marietta, Ga.

[73] Assignee: Riverwood International Corporation, Atlanta, Ga.

[21] Appl. No.: 649,364

[22] Filed: May 17, 1996

[51] Int. Cl.[6] ..... B65B 5/462

[52] U.S. Cl. ..... 229/117.14; 229/117.13

[58] Field of Search ..... 229/117.12, 117.13, 229/117.14

[56] References Cited

U.S. PATENT DOCUMENTS

| | | | |
|---|---|---|---|
| 2,868,433 | 1/1959 | Anderson, Jr. | 229/117.13 |
| 2,955,739 | 10/1960 | Collura | 229/117.13 |
| 3,076,591 | 2/1963 | Nute et al. | 229/117.13 |
| 3,112,856 | 12/1963 | MacIntosh et al. | 229/117.12 |
| 3,994,432 | 11/1976 | Kirby, Jr. | 229/117.13 |
| 4,378,905 | 4/1983 | Roccaforte | 229/117.13 |
| 4,498,619 | 2/1985 | Roccaforte | 229/117.13 |
| 4,538,759 | 9/1985 | Dutcher | 229/117.13 |
| 4,546,914 | 10/1985 | Roccaforte | 229/117.13 |
| 4,588,084 | 5/1986 | Holley, Jr. | 229/117.12 |
| 5,119,985 | 6/1992 | Dawson et al. | 229/117.13 |

FOREIGN PATENT DOCUMENTS

| | | | |
|---|---|---|---|
| 2481231 | 10/1981 | France | 229/117.13 |
| 2206565 | 1/1989 | United Kingdom | 229/117.13 |

*Primary Examiner*—Gary E. Elkins

[57] ABSTRACT

A carrier having an integral handle extending from one end panel to the other. The top panel is formed by overlapping flaps extending from the side panels. A handle strap extending along the length of the carrier is defined by spaced slits in the overlapped top panel flap and by a single slit and a spaced edge in the overlapping top panel flap. A reinforcing flap is adhered to the overlapped top panel flap. The handle straps overlie and are adhered to each other to form a two-ply handle. The reinforcing flap spans the opening vacated by the handle straps when the carrier is lifted.

10 Claims, 4 Drawing Sheets

ARTICLE CARRIER WITH INTEGRAL HANDLE

FIELD OF THE INVENTION

This invention relates to article carriers which incorporate integrally formed handles. More particularly, it relates to a carrier of this type which has a handle extending the length of the carrier.

BACKGROUND OF THE INVENTION

Article carriers are normally provided with a handle for convenient lifting. Although it may take many forms depending on the type of carrier involved, a satisfactory handle should be designed so as to be readily grasped, comfortable to the hand and capable of lifting the carrier without tearing. For carriers containing heavy loads, such as beverage cans or bottles, it is often necessary to reinforce the handle by making it of multi-ply construction. For example, in fully enclosed sleeve-type carriers the top panel is often formed by overlapping top panel flaps located at the ends of a blank. Each flap contains a handle opening arranged so that the top panel of the carrier includes two spaced openings. This arrangement is sometimes referred to as a "suitcase handle" since the strap portion of the top panel between the handle openings is gripped in the manner of a suitcase handle. Although the strap is made stronger by this two-ply construction, lifting stresses are still concentrated within a small area at the ends of the short strap and the edges of the handle openings.

An alternative to the suitcase type of handle is an elongated strap extending from one end panel to the other. This has the advantage of distributing lifting stresses to the ends of the carrier where they are more readily disseminated with less risk of tearing the carrier. Such an arrangement, however, can introduce other problems. If the handle is formed as an integral part of the top panel, it separates from the top panel when lifted, leaving an opening in the top panel through which dirt and dust can enter. If the handle is attached as a separate unit the top panel can remain intact but the carrier fabrication process is made more complicated.

One attempt to provide an integral handle which leaves the top panel substantially intact is disclosed in U.S. Pat. No. 5,328,081. In the disclosed design the carrier is formed from a blank in which the top panel section is an interior part of the blank and the handle is formed from portions of the top panel which are folded accordion fashion and glued together. The handle is of two-ply construction extending along the full length of the carrier, and the top panel remains intact when the handle is raised during lifting. The problem with this design, however, is that it requires extra folding and gluing steps to form the handle from the top panel section.

It would be highly desirable to be able to provide a carrier with an integral multi-ply handle which extends from one end of the carrier to the other, leaves the top panel intact when in use and does not require the interior of the top panel section to be folded and glued as in the carrier of U.S. Pat. No. 5,328,081. It is therefore an object of the invention to provide an integral handle which meets these objectives.

BRIEF SUMMARY OF THE INVENTION

The invention is incorporated in a carrier comprising opposite side panels connected to a top panel, a bottom panel and opposite end panels. The top panel is comprised of overlapping top panel flaps which are adhered to each other in the overlapping area. Each flap includes a handle strap in the overlapping area connected at its ends but capable of being raised above the top panel between the handle ends. In addition, a reinforcing sheet is adhered to the inner face of the inner top panel flap on opposite sides of the handle strap but not to the inner face of the handle strap.

With this arrangement, when the carrier is lifted by the handle the adhered handle straps are raised above their top panel flaps. However, because the reinforcing sheet adhered to the inner top panel flap spans the opening left by the raised handle straps, the top panel continues to provide a closed covering for the articles packaged in the carrier.

Preferably, the handle straps extend into the upper end panel flaps connected to the top panel flaps, and the reinforcing sheet is a flap foldably connected to the inner top panel flap. Also, the handle may be further reinforced to make it of three-ply construction, if desired. The carrier is simple to fabricate and does not make use of handle straps formed from a continuous top panel section as in the prior art, thereby avoiding problems caused by such design.

The features of the invention which enable it to provide the desired results are brought out in more detail in the description of the preferred embodiments, wherein the above and other aspects of the invention, as well as other benefits, will readily become apparent.

DETAILED DESCRIPTION OF THE PREFERRED EMBODIMENTS

Figure 1:
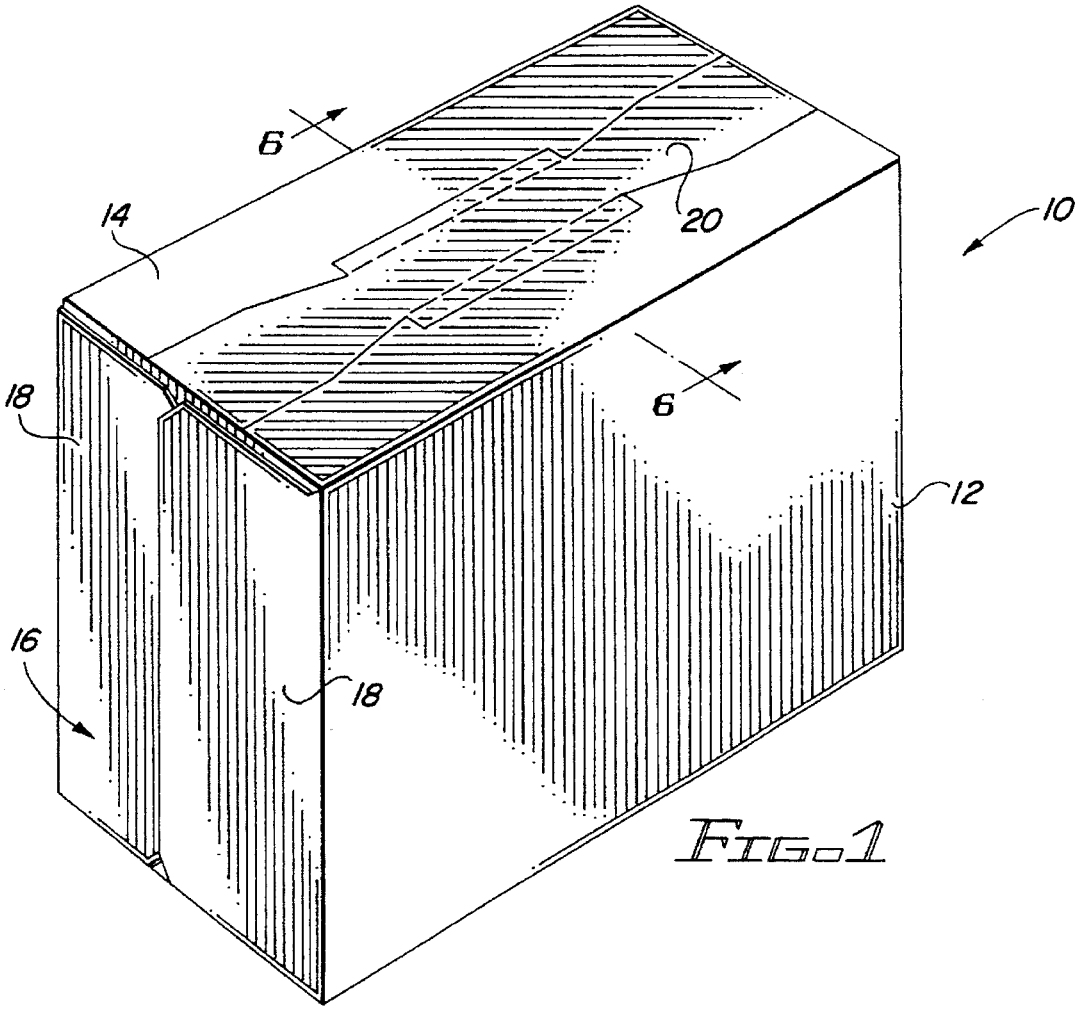
FIG. 1 is a pictorial view of a sleeve-type carrier which incorporates the handle of the present invention.

Referring to FIG. 1, a carrier 10 is comprised of side panels 12 connected to top panel 14 and to a bottom panel which is hidden in this view. The carrier also includes end panels 16 formed of end panel flaps connected to the top, side and bottom panels. The major end flaps 18, which are connected to the side panels, are visible in this view. Included in the top panel is handle 20, which extends between the end panels and is of multi-ply construction as described in more detail below.

Figure 2:
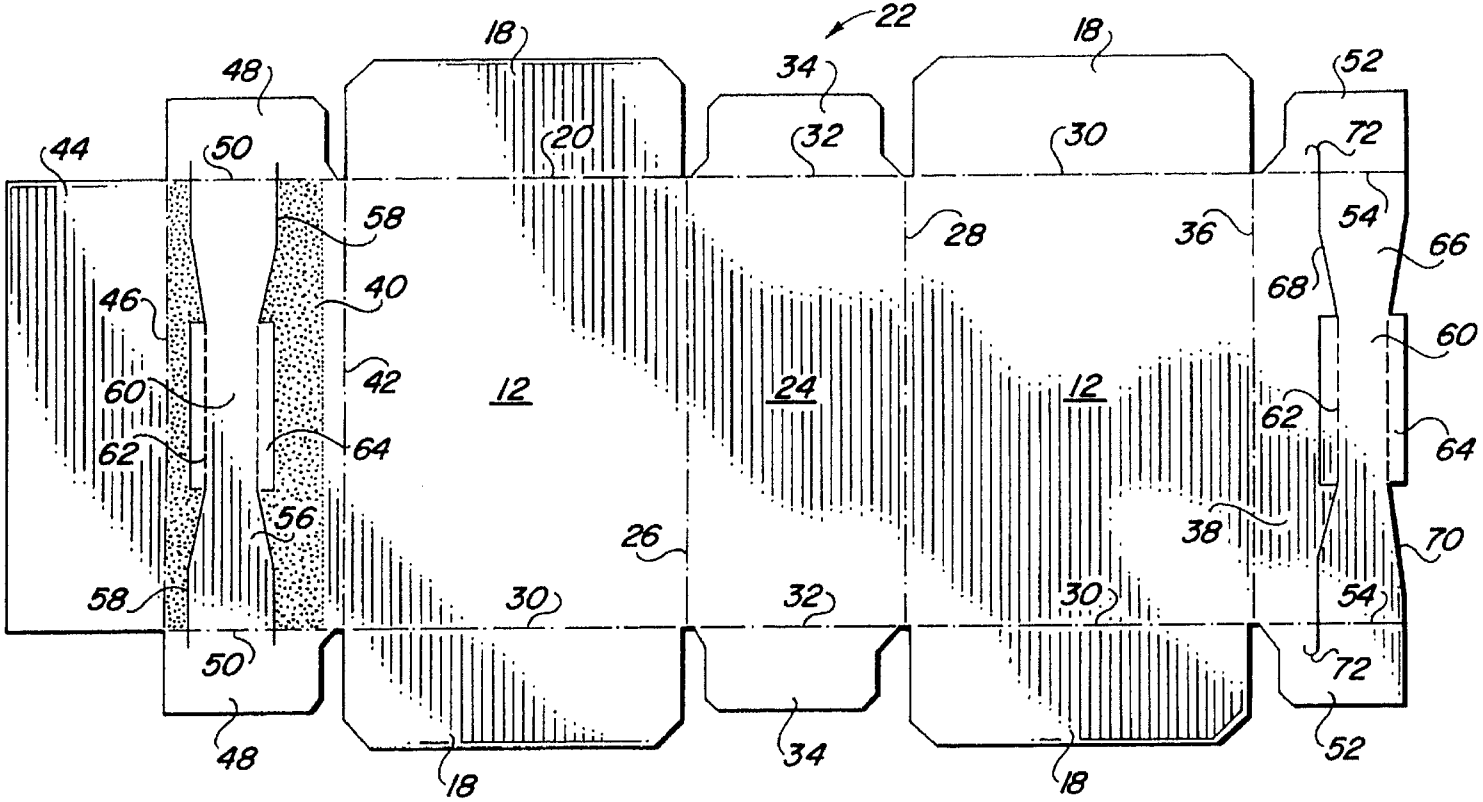
FIG. 2 is a plan view of a blank for forming the carrier of FIG. 1.

Referring now to FIG. 2, a generally rectangular blank 22 from which the carrier is formed is comprised of bottom panel section 24 connected by opposite fold lines 26 and 28 to side panel sections 12. Fold lines 30 connect the side panel sections 12 to the end panel flaps 18, while fold lines 32 connect the bottom panel section 24 to lower end panel flaps 34. Connected by fold line 36 to the side panel section at the right of the blank is top panel flap 38. Another top panel flap 40 is connected to the side panel section at the left of the blank by fold line 42, and reinforcing flap 44 at the end of the blank is connected to the top panel flap 40 by fold line 46. Upper end panel flaps 48 are connected to the top panel flap 40 by fold lines 50. Similarly, upper end panel flaps 52 are connected to the top panel flap 38 by fold lines 54. The fold lines 30, 32, 50 and 54 are aligned and form continuous fold lines.

Located in the top panel flap 40 is handle strap 56, which is defined by spaced slits 58. The slits are parallel at the end portions of the handle strap and converge to a central handle grip portion 60 where in conjunction with parallel fold lines 62 they define handle grip flaps 64. The spaced parallel end portions of the slits extend a short distance into the upper end panel flaps 48.

The top panel flap 38 incorporates handle strap 66 which is similar in size and shape to handle strap 56 except that only one side is defined by slit 68, the other side being defined by the edge 70 of top panel flap 38. As in the handle strap 56, fold lines 62 are provided in the handle grip portion 60 to form handle grip flaps 64. The slit 68 extends into the upper end panel flaps 52, preferably terminating in arcuate end portions 72.

Figure 4:
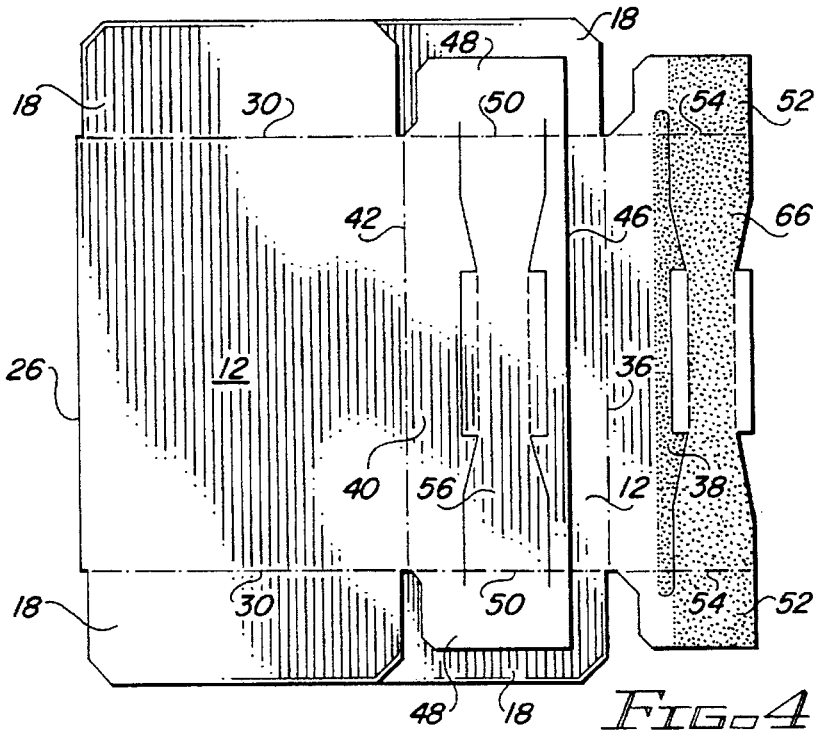
FIG. 4 is a plan view of the blank after a second folding step.
Figure 3:
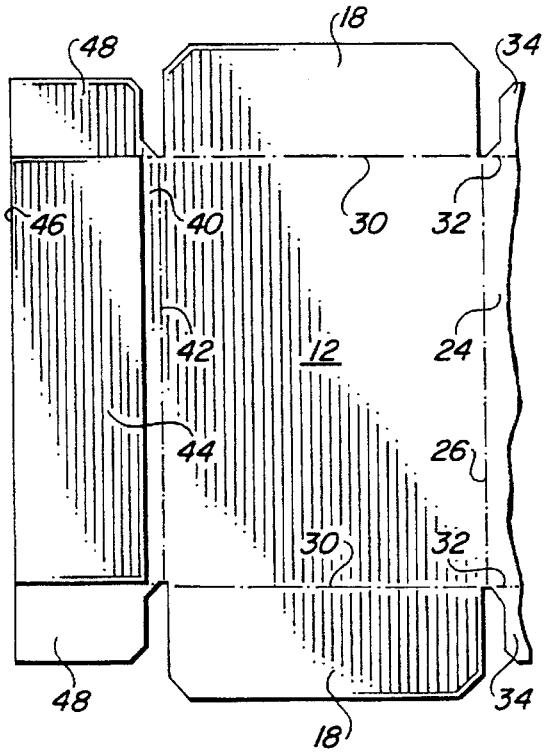
FIG. 3 is a partial plan view of the blank of FIG. 2 after an initial folding and gluing step.
Figure 5:
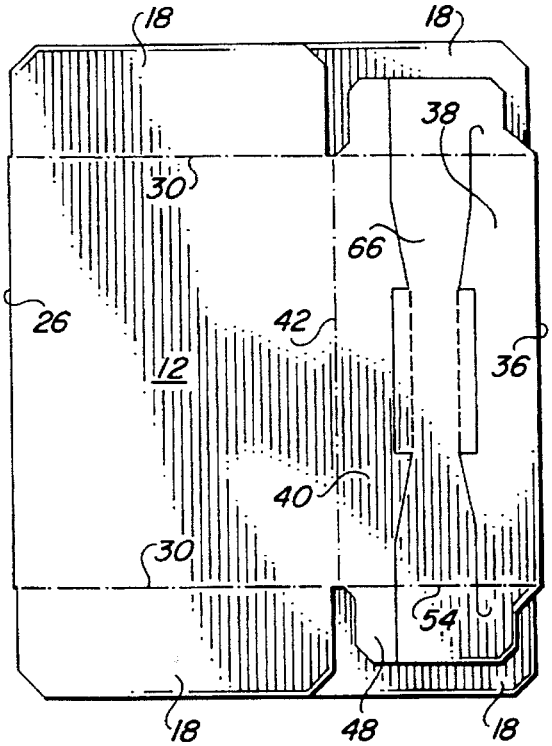
FIG. 5 is a plan view of a collapsed carrier formed as a result of a third folding step.

To form a carrier from the blank the reinforcing flap 44 is first folded about fold line 46 and glued to the stippled area of top panel flap 40, resulting in the interim form of blank illustrated in FIG. 3. The side panel section 12 at the left of the blank and the connected top panel flap 40 are then pivoted as a unit about fold line 26 to form the interim configuration shown in FIG. 4. The final step is to apply glue to the stippled area of the handle strap 66 shown in FIG. 4 and fold the top panel flap 38 about fold line 36. This causes the handle strap 66 to overlie handle strap 56, adhering the handle straps together. The result is the flattened tube or collapsed carrier of FIG. 5.

Figure 6:
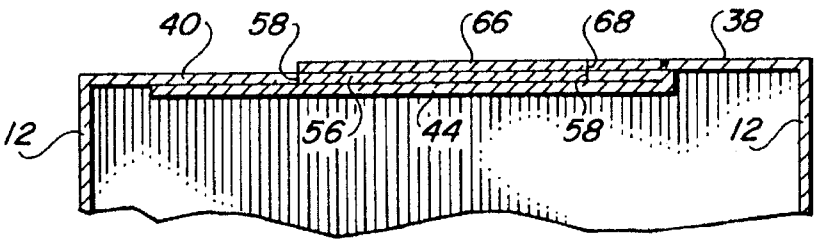
FIG. 6 is an enlarged transverse sectional view of the top panel of the carrier taken on line 6—6 of FIG. 1.

Typically, collapsed carriers are shipped to a packaging facility where they are erected, loaded with the articles being packaged and their ends closed by means well known in the industry to form the finished carrier of FIG. 1. As shown in FIG. 6, the handle strap 66 of the outer top panel flap 38 is adhered to and overlies the handle strap 56 of the inner top panel flap 40, and the reinforcing flap 44 is adhered to the top panel flap 40 but not to the adjacent handle strap 56.

Figure 7:
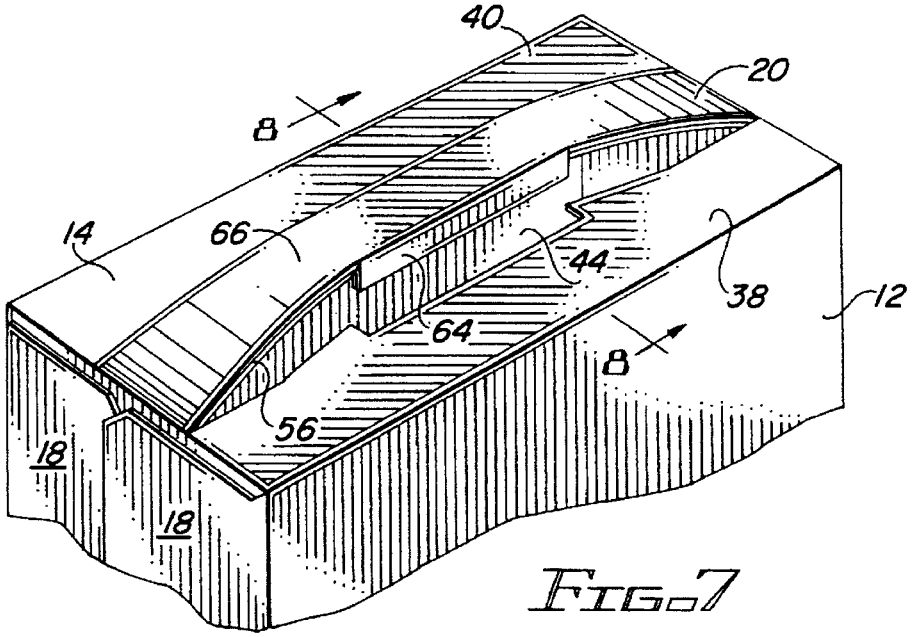
FIG. 7 is a partial pictorial view of the carrier of FIG. 1, showing the handle in operative condition.
Figure 8:
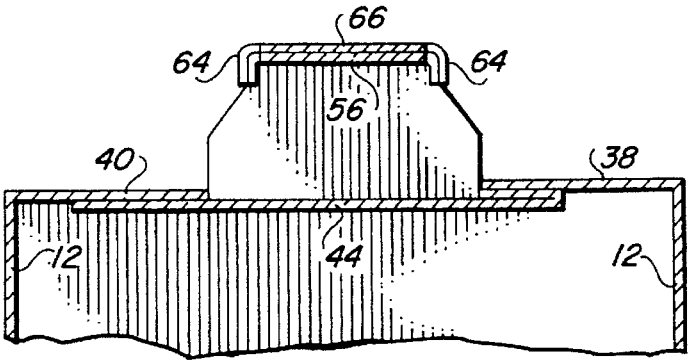
FIG. 8 is an enlarged transverse sectional view of the top panel of the carrier taken on line 8—8 of FIG. 7.
Figure 9:
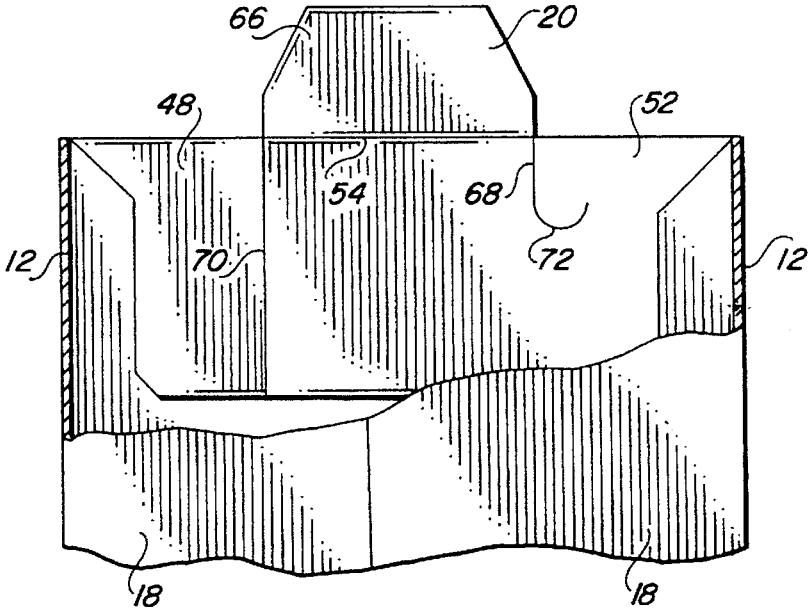
FIG. 9 is a partial end view of the carrier shown in FIG. 7.

To utilize the two-ply handle 20, the slit 68 which separates the handle strap 66 from the top panel flap 38 and the slits 58 which separate the handle strap 56 from the top panel flap 40 permit a user to raise the handle 20 above the top panel of the carrier and lift the carrier by the handle. When the carrier is lifted the user's hand folds the handle grip flaps 64 down and the weight of the carrier causes the handle to bow upwardly, as illustrated in FIGS. 7 and 8. The contents of the carrier remain completely covered by virtue of the reinforcing flap 44 which remains in place when the handle is raised. The result is a strong two-ply handle which extends from one end of the carrier to the other, thus distributing lifting stresses to the relatively strong end panels rather than to the top panel. The reinforcing flap 44 also provides the top panel with a two-ply construction at opposite sides of the handle opening. As seen in the partial end view of FIG. 9, the arcuate end 72 of the slit 68 prevents tearing of the upper end panel flap 52. The risk of tearing is further lessened by the two-ply construction of the upper end panel flaps. Further, there is little or no risk of tearing at the opposite edge of the strap since that edge corresponds to the edge 70 of handle strap 66.

Figure 10:
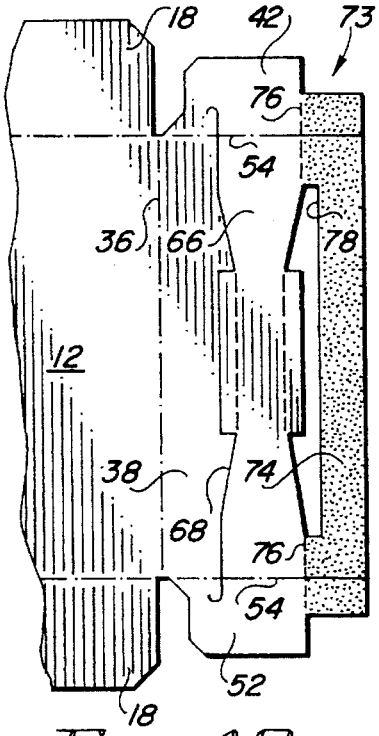
FIG. 10 is a partial plan view of a blank for forming a modified handle.

If the packaged load requires even more handle strength a third ply can be added. Referring to FIG. 10, the blank 73 is identical to the blank 22 except for the illustrated end portion. In this embodiment handle reinforcing strap 74 is connected to the outer edge of the handle strap 66 by fold lines 76, which correspond to the outer edge of the widest part of the strap 66. The reinforcing strap 74 is recessed at 78 to make the width of the central portion of the strap 74 substantially equal to the width of the central portion of the strap 66. When fabricating a carrier from the blank 73 glue is applied to the reinforcing strap 74, as shown in stipple in FIG. 10, and the strap is folded about the fold lines 76 and glued to the handle strap 66. Other than this difference, fabrication proceeds in the same manner as described in connection with the blank 22.

Figure 11:
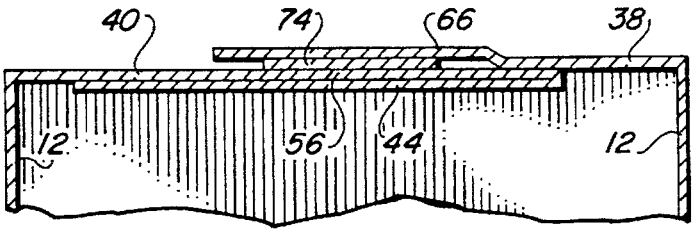
FIG. 11 is an enlarged transverse sectional view similar to that of FIG. 6, but showing the top panel of the modified carrier.

The top panel of the resulting modified carrier is shown in FIG. 11 to be similar to the top panel of the first embodiment except for the handle being of three-ply construction instead of two-ply construction. When the three-ply handle is raised above the top panel and grasped in the same manner as the handle in the first embodiment, the carrier can then be lifted by the handle, leaving the flap 44 in place to cover the opening formed by the vacated handle strap 56. It may be desirable to omit at least some of the handle flaps 64 in the handle strap 56 in this embodiment due to the three-ply construction of the handle. Although it is preferred to include handle flaps on at least the outer handle strap to protect a user's hand from the edge of the handle, the flaps 64 may be omitted entirely if desired.

It should now be apparent that the invention provides an integral multi-ply handle of sufficient strength to lift heavy loads with little or no risk of tearing. Because the top panel is formed from connected flaps, the handle structure can be made part of the flaps, thereby avoiding the interior folding and gluing steps required by the carrier disclosed in U.S. Pat. No. 5,328,081. Moreover, the top panel is reinforced by the reinforcing flap 44, which in addition to strengthening the top panel also provides for a fully enclosed top panel even after the handle has been separated from the top panel flaps and has been raised during lifting.

The invention is not intended to be limited to the specific carrier design described, but may be incorporated in other carrier designs in which the top panel is formed from connected top panel flaps. Because the invention is not necessarily limited to all the specific details described in connection with the preferred embodiments, except as they may be within the scope of the appended claims, changes to certain features of the preferred embodiments which do not alter the overall basic function and concept of the invention are contemplated.

What is claimed is:

1. A blank for forming an article carrier, comprising:

a bottom panel section connected by fold lines to opposite side panel sections;

one of the side panel sections being connected to a first top panel flap by a fold line and the opposite side panel section being connected to a second top panel flap by a fold line;

end panel flaps connected by fold lines to opposite ends of the side panel sections and the first and second top panel flaps;

means for defining a handle strap in each of the first and second top panel flaps, each handle strap having opposite ends, each handle strap being connected at the ends thereof to the associated top panel flap substantially at the fold lines connecting said associated top panel flap to an associated end panel flap, said means permitting each handle strap to be raised above the associated top panel flap between the ends of the handle strap; and a reinforcing flap connected to the second top panel flap by a fold line, the reinforcing flap extending beyond the width of the handle strap associated with the second top panel flap when folded about said connecting fold line;

the dimensions of the top panel flaps and the handle straps being such that at least a portion of the first top panel flap overlaps at least a portion of the second top panel flap in a carrier formed from the blank and the handle strap in the first top panel flap overlies the handle strap in the second top panel flap in such a carrier.

2. A blank as defined in claim 1, wherein the first top panel flap terminates at an edge of the handle strap included therein.

3. A blank as defined in claim 1, wherein the handle strap in the second top panel flap is defined by slits, the handle strap in the first top panel flap being defined by a slit and an edge of the first top panel flap, the slits extending into the upper end panel flaps.

4. A blank as defined in claim 1, wherein the handle strap in the first top panel flap includes a reinforcing flap foldably connected to said edge of the first handle strap.

5. An article carrier, comprising:

opposite side panels connected to a top panel, a bottom panel and opposite end panels;

the top panel being comprised of a first top panel flap foldably connected to one of the side panels and a second top panel flap foldably connected to the opposite side panel, each top panel flap having outer and inner faces and opposite ends;

at least a portion of the first top panel flap overlapping and being adhered to at least a portion of the second top panel flap;

an upper end panel flap connected to each of the ends of each of the first and second top panel flaps by a fold line;

means for defining a handle strap in each of the first and second top panel flaps, each handle strap having opposite ends and outer and inner faces, each handle strap being connected at the ends thereof to the associated top panel flap substantially at the fold lines connecting said associated top panel flap to an associated end panel flap, said means permitting each handle strap to be raised above the associated top panel flap between the ends thereof;

the handle strap in the first top panel flap overlying and being adhered to the handle strap in the second top panel flap; and a reinforcing sheet adhered to the inner face of the second top panel flap on opposite sides of the handle strap in the second top panel flap and extending throughout the length of the handle strap in the second top panel flap, the reinforcing sheet being adjacent but unadhered to the inner face of said handle strap in the second top panel flap.

6. An article carrier as defined in claim 5, wherein the reinforcing sheet is a flap foldably connected to the second top panel flap.

7. An article carrier as defined in claim 5, wherein the first top panel flap terminates at an edge of the handle strap included therein.

8. An article carrier as defined in claim 5, wherein the means for defining a handle strap in each of the top panel flaps are comprised of slits, the slits extending into the upper end panel flaps.

9. An article carrier as defined in claim 5, wherein the handle strap in the first top panel flap includes a reinforcing strip adhered to the inner face of said handle strap in the first top panel flap.

10. An article carrier as defined in claim 9, wherein the reinforcing strip is a flap foldably connected to the handle strap in the first top panel flap.

* * * * *